United States Patent [19]

Berfield et al.

[11] Patent Number: 4,701,969

[45] Date of Patent: Oct. 27, 1987

[54] ROTARY BRUSH SWEEPER WITH EASILY SEPARABLE DEBRIS PAN

[75] Inventors: Robert C. Berfield, Jersey Shore; Craig A. Seasholtz, Avis; Richard M. Fegan, Cogan Station, all of Pa.

[73] Assignee: Shop-Vac Corporation, Williamsport, Pa.

[21] Appl. No.: 918,661

[22] Filed: Oct. 15, 1986

Related U.S. Application Data

[63] Continuation of Ser. No. 826,545, Feb. 2, 1986, abandoned.

[51] Int. Cl.[4] ..... E01H 1/05

[52] U.S. Cl. ..... 15/79 R; 15/41 R; 15/49 C; 15/83

[58] Field of Search ..... 15/41 R–45, 15/48, 79 R, 79 A, 83, 49 C, 50 C, 383

[56] References Cited

U.S. PATENT DOCUMENTS

| | | | |
|---|---|---|---|
| 057,949 | 4/1913 | Ekre . | |
| 481,269 | 8/1892 | Thompson . | |
| 552,887 | 1/1896 | Branth . | |
| 688,189 | 12/1901 | Mason . | |
| 849,941 | 3/1932 | Lofstrand . | |
| 850,777 | 4/1907 | Mosher . | |
| 907,755 | 12/1905 | De Spain . | |
| 984,336 | 2/1911 | Woodbury . | |
| 998,544 | 7/1911 | Mosher . | |
| 1,057,949 | 4/1913 | Ekre . | |
| 1,849,941 | 3/1932 | Lofstrand . | |
| 2,101,133 | 12/1937 | Dilliard | 15/41 R |
| 2,178,917 | 2/1938 | Pullen . | |
| 2,205,249 | 6/1940 | Fitzgerald et al. . | |
| 2,206,429 | 7/1940 | Redfearn | 15/41 R |
| 2,670,485 | 3/1954 | Gomez . | |
| 2,689,367 | 9/1954 | Parker . | |
| 2,834,034 | 5/1958 | Angell . | |
| 2,986,755 | 6/1961 | Sobie et al. . | |
| 3,048,868 | 8/1962 | Clark . | |
| 3,284,830 | 11/1966 | Kroll . | |
| 4,071,920 | 2/1978 | Block . | |
| 4,366,593 | 1/1983 | Parikh . | |

FOREIGN PATENT DOCUMENTS

| | | | |
|---|---|---|---|
| 2845212 | 10/1979 | Fed. Rep. of Germany | 15/79 A |
| 147101 | 6/1930 | Switzerland . | |

*Primary Examiner*—Edward L. Roberts

*Attorney, Agent, or Firm*—Ostrolenk, Faber, Gerb & Soffen

[57] ABSTRACT

A rotary brush sweeper includes a debris pan with an inlet portion that glides on a surface being cleaned. The debris pan automatically disengages from the sweeper upon being engaged by an obstacle in the path of the sweeper. Rotary brooms may be attached to the left and right front sides of the sweeper. The support structure for the front wheel provides broom-to-ground height adjustment for the side brooms. Additionally, brush-to-ground height adjustment is obtained through a support structure for the front wheel. The axle of the rotary brush is held in place under the tension of a drive belt for the rotary brush.

40 Claims, 12 Drawing Figures

ROTARY BRUSH SWEEPER WITH EASILY SEPARABLE DEBRIS PAN

This application is a Continuation of application Ser. No. 826,545 filed Feb. 2, 1986 now abandoned.

BACKGROUND OF THE INVENTION

The present invention relates to a rotary brush sweeper including a debris pan that automatically disengages from the sweeper upon being snagged by an obstacle.

Rotary brush sweepers include debris pans for collection of debris that is swept into the pans by the rotary brush. Particularly when a sweeper is used in an outdoor environment, where obstructions, such as rocks, cracked sidewalk or pavement are frequently present on a surface to be cleaned, the debris pan of the sweeper may become snagged on an obstruction. It is undesirable for the entire sweeper to consequently come to an abrupt stop. An unpleasant and potentially harmful shock is then imparted to the user and the debris pan may be cracked or bent by the impact. Furthermore, the mounting, dismounting and remounting of a debris pan is typically a cumbersome process and may involve lifting or tipping the sweeper.

To effectively collect dirt from an uneven surface, as in an outdoor environment, the entrance to the debris pan, into which the brush sweeps the dirt, should desirably remain near the ground. Prior sweeper debris pans do not enable this. Also, brush height adjustment is desirable and this too is not easy with many prior sweeper debris pans.

SUMMARY OF THE INVENTION

It is accordingly an object of the present invention to provide a rotary brush sweeper including a debris pan that automatically disengages from the remainder of the sweeper upon being snagged by an obstacle.

Another object of the invention is to enable the debris pan to be readily mounted, dismounted and remounted.

Yet another object of the invention is to enable easy height adjustment of the brush and the sweeper.

A further object is to enable the debris collection pan to ride over a possibly uneven surface and still collect debris therefrom.

A still further object is to provide a rotary brush sweeper that is simple in design and can be easily assembled.

The invention relates to a rotary brush sweeper for removing debris from a surface. The sweeper includes a housing. A pair of ground riding rear wheels is rotatably mounted on the housing. One of the rear wheels serves as a drive wheel for driving a rotary brush that is disposed forward of the rear wheels. A front wheel is also rotatably mounted on the housing.

A debris pan is situated between the rear wheels. It has an inlet extending toward the front wheel and located behind the sweeping brush. The debris pan includes a bottom, a rear wall extending upwardly from the bottom, and a pair of confronting sides which together form an open topped enclosure with the bottom and rear wall. The inlet of the debris pan is formed by the bottom and sides of the pan. Rear support means on the rear of the housing removably support the rear of the debris pan. The rear support means comprise a laterally extending aperture in the rear wall of the pan, and a tab projecting from the housing in a rearward and upward direction and which is adapted to protrude through the pan aperture to support the pan. In a preferred arrangement, the rear support means further comprises a detent projecting rearwardly from the rear of the pan. The detent is adapted to extend into the further aperture. Means are provided to bias the detent into the aperture so that the pan is supported by the housing in a sturdy manner. Front support means for removably supporting the front of the debris pan comprises front support members, which may be the sides of the debris pan, fixed to the pan. That front support means further comprises a laterally extending support member projecting, directly or indirectly, from the housing and being situated beneath the pan support member when the pan is in a supported position.

The rotary brush is of generally cylindrical form and is situated in front of the debris pan but behind the front wheel and includes an axle supported at least in part by the housing. Drive means coupling the rotary brush to the drive wheel rotates the brush when the drive wheel is rotated. The rotary brush rotates in the same direction as the drive wheel.

As the rotary brush sweeper is moving, upon the debris pan striking an obstacle, the debris pan automatically disengages from both of the front and the rear support means of the sweeper which prevents impact shock to the pan and to the user.

In a preferred embodiment of the invention, the front of the debris pan is shaped to be capable of gliding in contact with and on a surface being swept by the rotary brush sweeper. Additionally, the pan support member of the front support means for the debris pan is spaced above the cooperating, laterally extending support member by a sufficient vertical dimension to permit vertical movement of the pan relative to the housing, thereby permitting the front of the pan to glide on the surface being cleaned, even when the contour of the surface varies.

Furthermore, a support for a front wheel of the sweeper is height adjustable and enables the brush to be moved slightly down or up as a particular situation may require. For example, wearing of the brush requires that the brush be moved downward to maintain a desired contact pressure with a surface being cleaned.

Rotary side brooms may be incorporated into the sweeper if desired. Broom-to-ground height adjustment is provided by the height adjustable support for the front wheel.

The invention will be better understood and its various objects and advantages will be more fully appreciated from the following description taken in conjunction with the accompanying drawings.

DESCRIPTION OF THE PREFERRED EMBODIMENTS

Figure 1:
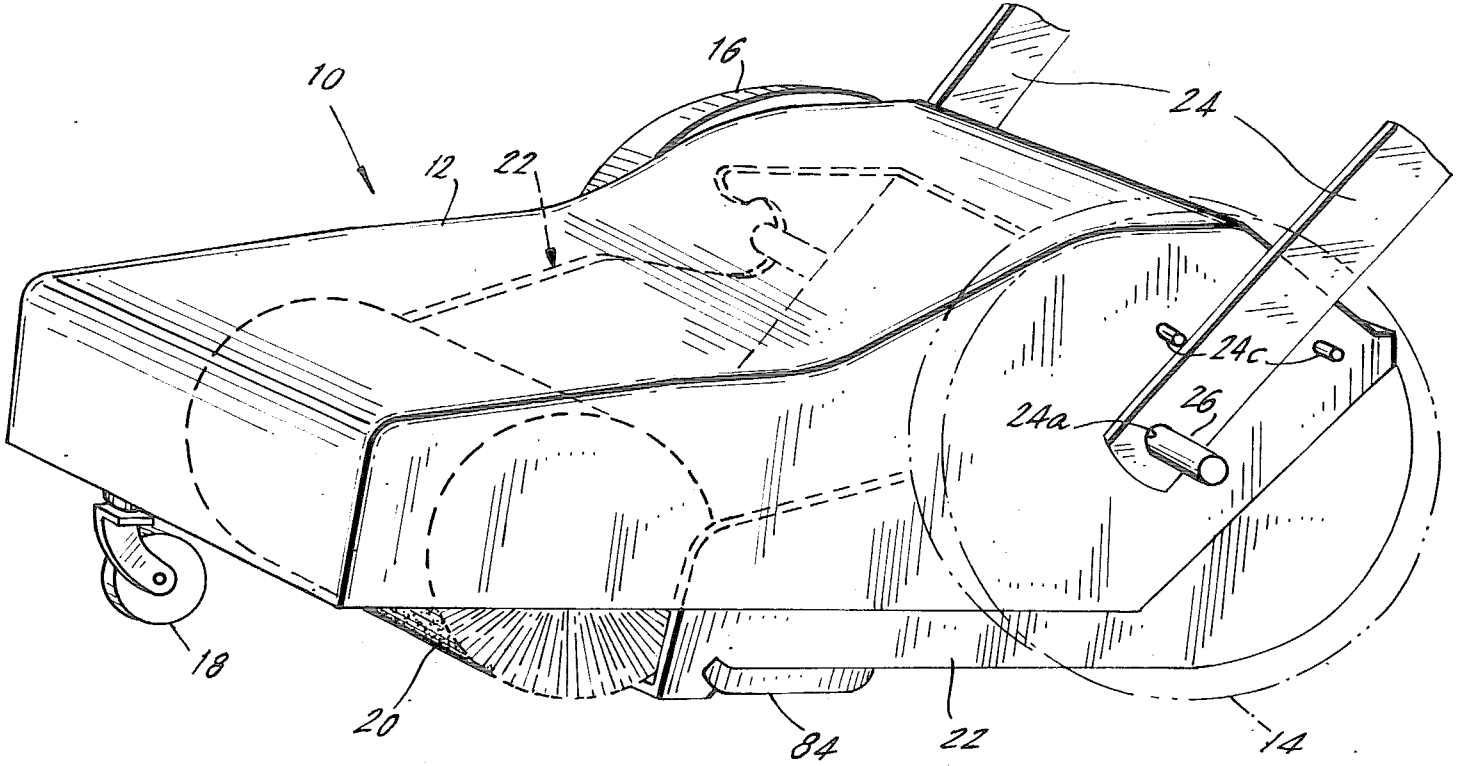
FIG. 1 is a simplified view in perspective of a rotary brush sweeper in accordance with the present invention, and illustrates selected parts of the sweeper.

Referring to the drawings in which like numbers refer to like parts, FIG. 1 illustrates selected parts of a rotary brush sweeper 10 in accordance with the present invention. Sweeper 10 includes a housing 12 of plastic, for example, onto which a pair of rear wheels 14 and 16 and a front wheel 18 are mounted. Wheels 14, 16 and 18 are shown only schematically in FIG. 1. Preferably, rear wheels 14, 16 each comprise a rubber tire mounted on a plastic hub, and front wheel 18 comprises a caster.

A rotary brush 20, preferably of the type having a twisted wire axle, is rotatably mounted onto housing 12 behind front wheel 18. Situated immediately behind rotary brush 20 (i.e., to the right in FIG. 1) is a debris pan 22 which collects debris that is swept into the pan by rotary brush 20. Debris pan 22 is described in more detail hereinafter.

A manually graspable handle 24 is attached to housing 12. Handle 24 includes a yoke portion (not shown) which may be conveniently grasped manually. In accordance with a preferred mounting arrangement of handle 24, the lower portion of one side of handle 24 (which is preferably symmetrical with the other side) has an aperture 24*a* through which a rod 26 extends. That rod preferably is the axle for rear wheel 14 (FIG. 1). A pair of stops 24*c* mounted on housing 24 limit the degree of rotation of handle 24 about rod 26.

Figures 2, 2A:
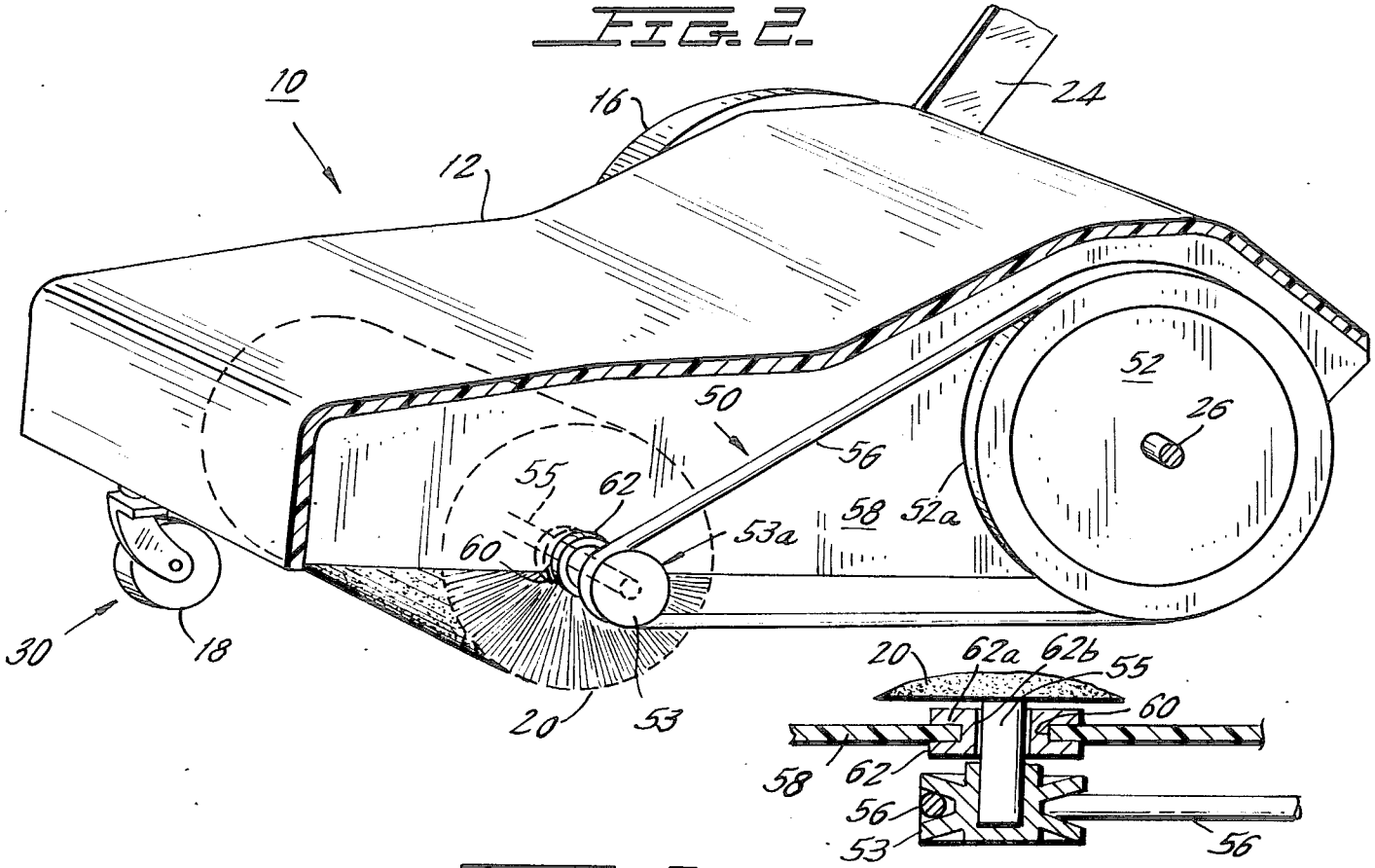
FIG. 2 is a perspective view of the rotary brush sweeper of FIG. 1 with various portions absent or cut away to better illustrate a drive mechanism of the sweeper.
FIG. 2A is a plan view in cross section of the axle support arrangement of FIG. 2, further illustrating a bushing that may be provided between the axle of the rotary brush and a portion of the housing that supports the axle.

FIG. 2 depicts rotary brush sweeper 10 with various portions removed or cut away to expose a drive system 50 for rotating rotary brush 20. Drive system 50 includes a drive pulley 52 fixedly mounted on rear axle 26, on which wheel 14, shown in FIG. 1, is also fixed, such that rotation of wheel 14 rotates drive pulley 52. The other rear wheel is free to idly revolve about rear axle 26. Drive system 50 also includes a driven pulley 53 so that rotary brush 20 is rotated at a higher rate than drive wheel 14 (FIG. 1). An endless rubber belt 56 that is slightly elastic is mounted under tension in respective circumferential grooves 52*a* and 53*a* on pulleys 52 and 53 and this transfers rotational movement of drive pulley 52 to driven pulley 53.

Further illustrated in FIG. 2 is a support panel 58, which depends from the upper portion of housing 12 and which supports the left-hand, or "drive" ends of rear axle 26 and rotary brush axle 55. The opposite, or right-hand, ends of axles 26 and 55 (not shown) are suitably supported by conventional bushings that permit free rotation of the axles. Rear axle 26 may be supported by panel 58 by extending through an aperture (not shown) in the panel, without a bushing for the axle. Support panel 58 includes a notch 60 in which axle 55 is received. The axle preferably is received in a bushing 62 mounted in notch 60. Notch 60 extends rearwardly and upwardly in support panel 58 from its opening. This simple mounting arrangement provided by notch 60 enables insertion of axle 55 into notch 60 and enables securement of the axle in position in the notch by belt 56 when the belt is under tension due to its mounting on pulleys 52 and 53.

Referring to FIG. 2A, bushing 62 between rotary brush axle 55 and support panel 58 has flat bottom grooves 62*a* on its opposite edges and these receive the portions of the support panel 58 forming the sides of notch 60, which prevents rotation of the bushing. The bushing includes an aperture 62*b* through which brush axle 55 extends. Bushing 62 may be of low-friction plastic or other low friction material.

Figures 3, 3A:
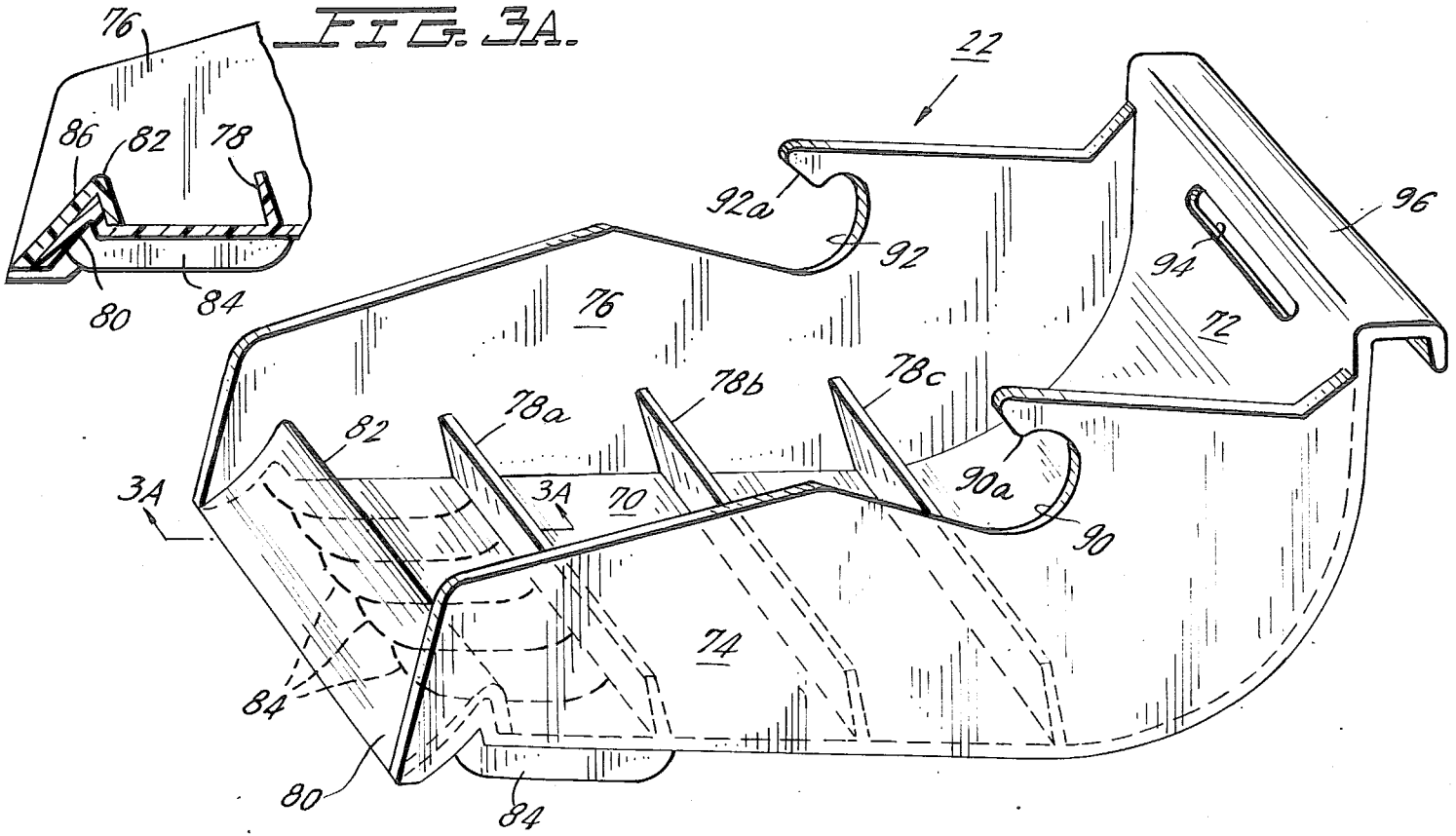
FIG. 3 is a perspective view of an exemplary debris pan in accordance with the invention.
FIG. 3A is a detailed view of an inlet portion of the debris pan of FIG. 3 and illustrates a layer of low friction material provided on the inlet portion.

Debris pan 22 of a first embodiment of the invention is partially shown in FIG. 1 and detailed in FIG. 3. Debris pan 22 is rigid and may be of metal or plastic, such as polypropylene. The pan includes a flat bottom 70, a curving rear wall 72 into which the bottom 70 merges, and confronting sides 74 and 76. Sides 74 and 76 are joined to bottom 70, a curving rear wall 72 into which the bottom 70 merges, and confronting sides 74 and 76. Sides 74 and 76 are joined to bottom 70 and rear wall 72 to form an open topped enclosure in which debris is collected. The top of the housing 12 completes that enclosure. A plurality of ribs 78*a*, 78*b* and 78*c* extend upwardly from pan bottom 70 and from side 74 and side 76. Ribs 78*a*–78*c* separate the interior of debris pan 22 into bins. Accordingly, once collected in a bin, debris in pan 22 is prevented from shifting to other portions of the pan or from shifting forward out of the debris pan in the event of a sudden stop or direction change.

The front of pan bottom 70 comprises a scoop 80, which is configured in arcuate fashion (FIG. 1) to facilitate sweeping of debris into debris pan 22. The upper edge of scoop 80 comprises a ridge 82 extending between pan sides 74 and 76, and together with lateral rib 78*a*, scoop 80 forms a forward bin in debris pan 22. It is preferred that scoop 80 at the front of the pan be covered with a low friction material layer 86, such as vinyl (FIG. 3A). This enhances the gliding of the pan over the surface and protects the front of the pan from excessive damage and wear.

Adjoining the underside of pan bottom 70 is a plurality of front-to-rear extending rails 84 which are extended to glide upon a surface which is being swept while positioning and setting the usual height of the front of scoop 80.

For mounting the debris pan 22 onto the housing 12 of the rotary brush sweeper, forward mounting arrangement of debris pan 22 includes notches 90 and 92 on pan sides 74 and 76, respectively. Each notch extends rearwardly and upwardly from its entrance opening 90*a* and 92*a*.

A rear mounting arrangement of pan 22 comprises a laterally-extending aperture 94 in pan rear wall 72. A generally hook-like tab 96 extends rearwardly from pan wall 72 above aperture 94. The tab serves as a handle for pan 22 while also strengthening the pan.

Figure 4:
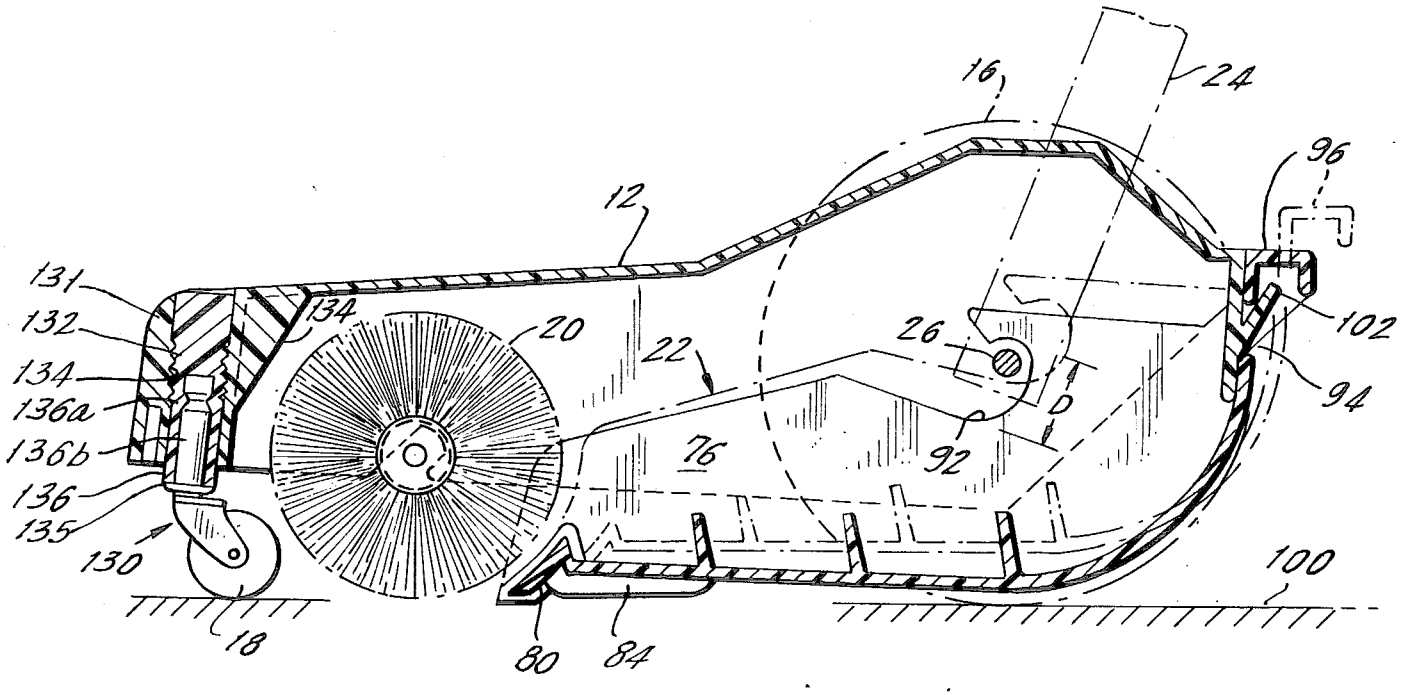
FIG. 4 is a side plan view of the rotary brush sweeper of the present invention and depicts the operation of the automatic disengagement means for the debris pan and the arrangement for adjusting the height of the front of the sweeper.

FIG. 4 shows the mounting of debris pan 22 to housing 12. Sweeper 10 is shown on surface 100, which is intended to be cleaned. To support the rear of debris pan 22, housing 12 includes a rearwardly and upwardly projecting tab 102 which is adapted to protrude through laterally extending aperture 94 in the rear wall of debris pan 22. Cooperating with this rear support means 94 and 102 is above described notch 92 and its counterpart 90, not seen in FIG. 4, and laterally-extending members 26, which advantageously is the axle for the rear wheels. Member 26 extends through notch 92 and the side of the pan rests on member 26. This serves as the forward support arrangement for the pan.

Debris pan 22 may be easily removed from the sweeper of the present invention by pulling on handle 96 of the pan in the rearward and upward direction. This frees the pan from the rear tab 102 and moves the notch 92 off the member 26. This disengaged position of debris pan 22 is shown in phantom in FIG. 4. Similarly, automatic disengagement of debris pan 22 from the sweeper results when forward movement of the pan along the sweeper housing is prevented by scoop 80 becoming snagged on an obstacle (not shown) on surface 100. Then the rear wall of the pan rides up and separates from tab 102 while the open front of the notch 92 permits the member 26 to separate from the pan.

Notch 92 of debris pan 22 is provided with a sufficient vertical dimension, D, so as to permit rails 84 of the debris pan to freely move up and down, due to unevenness in the cleaned surface 100, for example. Accordingly, scoop 80 of the pan can glide over surface 100 in close proximity thereto despite changes in the contour of the surface.

Also depicted in FIG. 4 is a simple and economical height adjustment mechanism 130 for adjusting the housing 12 to front wheel 18 height. Such height determines the extent of contact, or pressure, of rotary brush 20 against surface 100. It enables adjustment for brush wear and for surface roughness. In its preferred form, height adjustment mechanism 130 includes a downwardly extending sleeve 131 that is defined at the front of the housing 12. The sleeve 131 includes an opening 132 into the front of housing 12. Opening 132 is provided with interior threads at 134 so that it may screw threadedly into an externally threaded swivel caster sleeve 136. An opening 135 in sleeve 136 receives the downwardly extending rod 136*b* of caster 18 for free swivelling. By simple clockwise or anticlockwise rotation of threaded sleeve 136 relative to downwardly extending sleeve 131, the height of housing 12 above front wheel 18 can be varied as desired.

Figure 5:
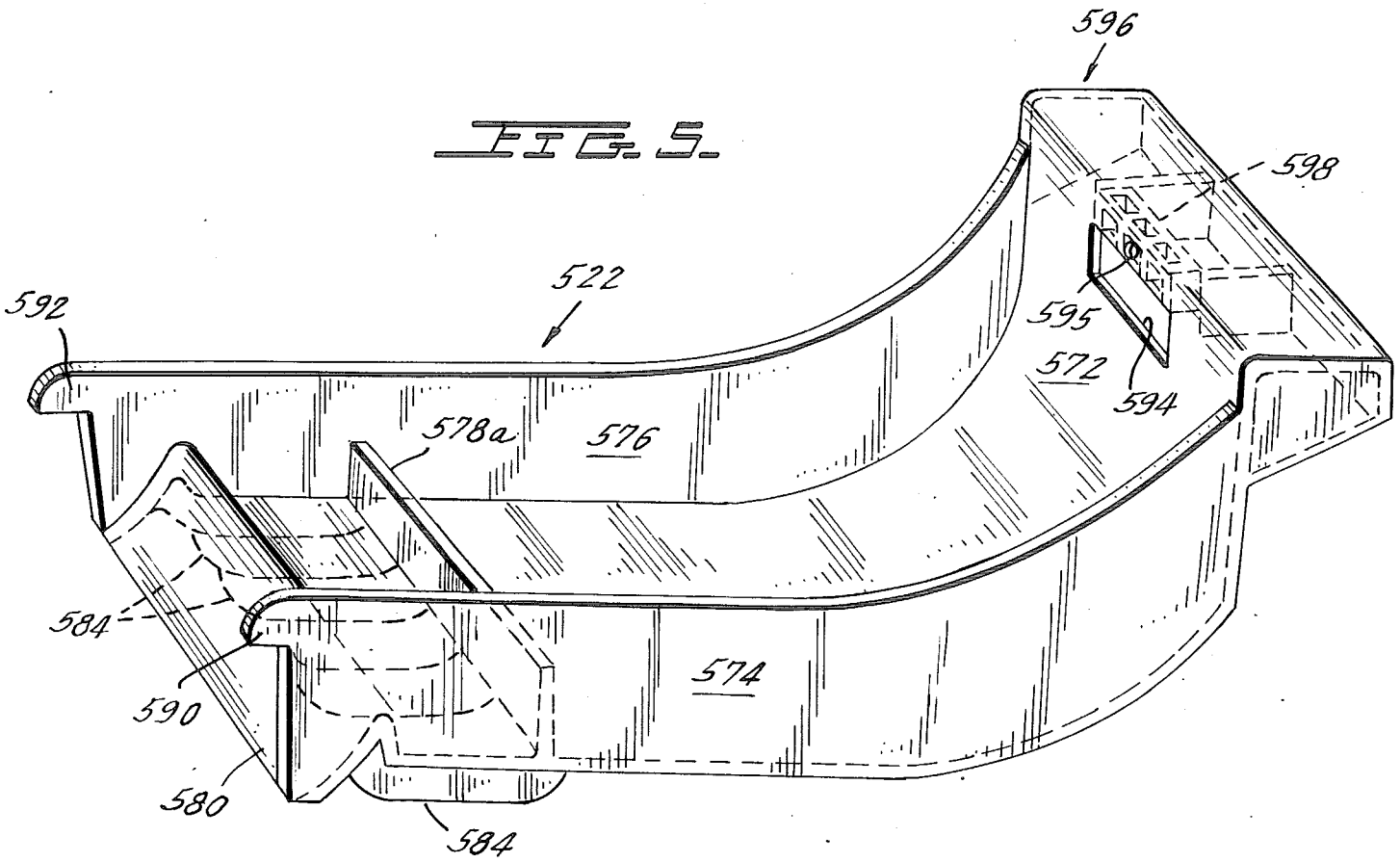
FIG. 5 is a perspective view of a debris pan in accordance with a further embodiment of the invention.

A debris pan 522 in accordance with the invention is shown in FIG. 5. Debris pan 522 is similar to debris pan 22 described above. Accordingly, parts of debris pan 522 that are similar to parts of debris pan 22 have reference numerals augmented by "500".

Rear-located aperture 594 is larger than aperture 94 of debris pan 22 (FIG. 3) for purposes that will become apparent below. An additional aperture 595 is provided above aperture 594. The aperture 595 cooperates with a detent in the housing 12, described below, so that the pan 522 is supported by the housing in a sturdy fashion.

The front of the pan 522 includes laterally-projecting members 590 and 592, which extend forwardly from pan sides 574 and 576, respectively. The members 590 and 592 are adapted to rest on a cooperating supporting structure mounted on the housing 12, as is described below.

Figures 6, 6A:
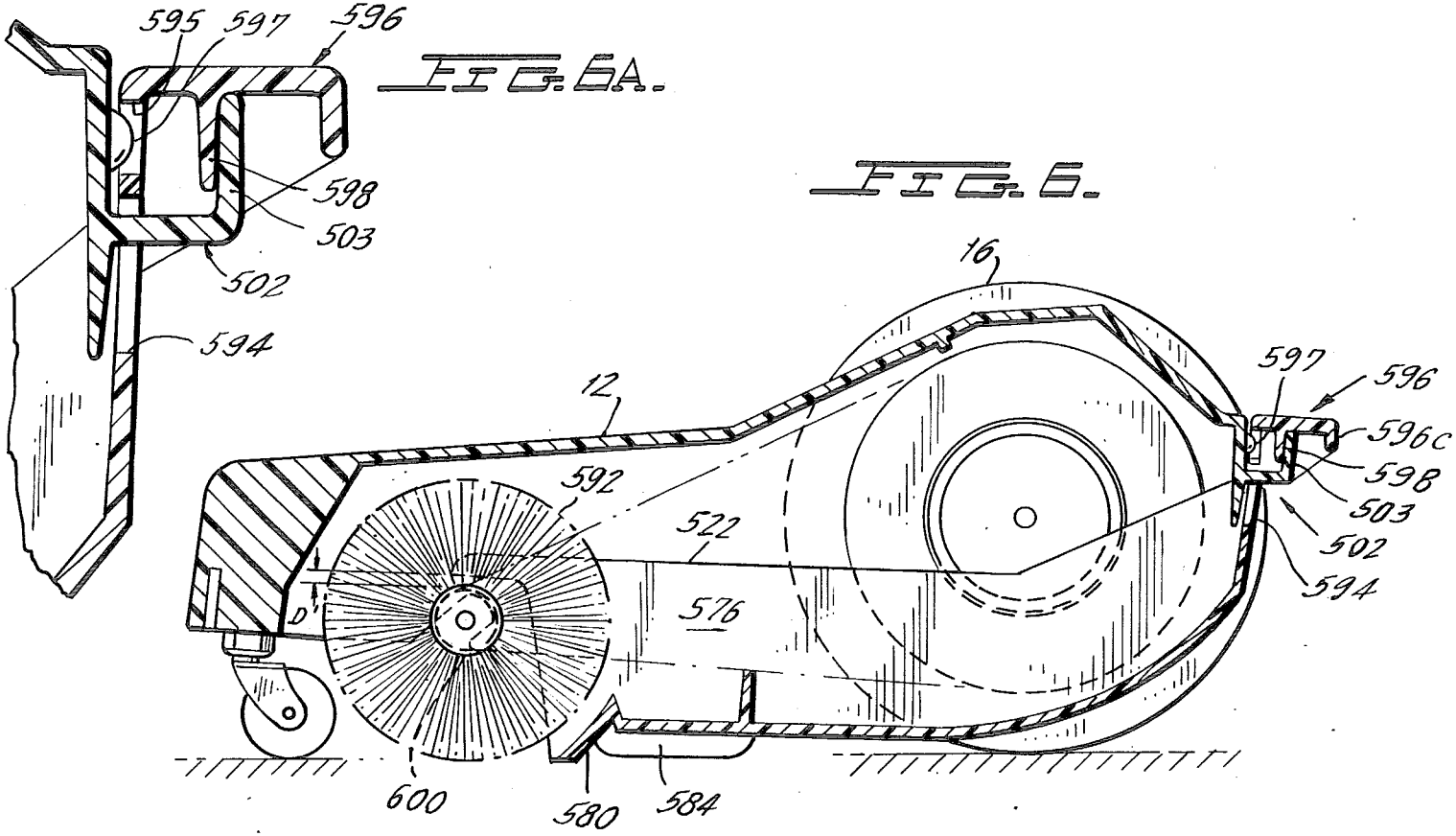
FIG. 6 is a side plan view of the rotary brush sweeper of the invention in which the debris pan of FIG. 5 is used.
FIG. 6A is a detailed view of a rear support arrangement for the debris pan shown in FIG. 6.

FIG. 6 shows the mounting of debris pan 522 to the housing 12. The front support member 592 is normally displaced by a distance "D" above a cooperating support 600 mounted on the inner side of support flange 58. The other front support member 590, not illustrated, is similarly normally situated above a support element corresponding to element 60. The corresponding support element is not shown, but may suitably comprise a bushing in which the far end of brush axle 55 (FIG. 2) is received. The normal clearance "D" allows the pan 522 to glide over the surface 100, even if the contour of the surface changes. The support member rests on the support, element 592 when the front of the sweeper is lifted, for example, to prevent the debris pan from falling away from the housing 12.

To support the rear of the debris pan 522, a rearwardly projecting tab 502, best seen in the detailed view in FIG. 6A, protrudes through the aperture 594 of the debris pan. Thus, the housing tab 502 supports the rear of the pan 522.

To hold the debris pan 522 sturdily in position, rearwardly projecting detent 597 is provided in the housing 12. The detent passes into aperture 595 of the pan. To bias the detent into the aperture, upwardly projecting portion 503 of housing tab 502 pulls against downwardly projecting flange 598 of the debris pan 522.

Figure 7A:
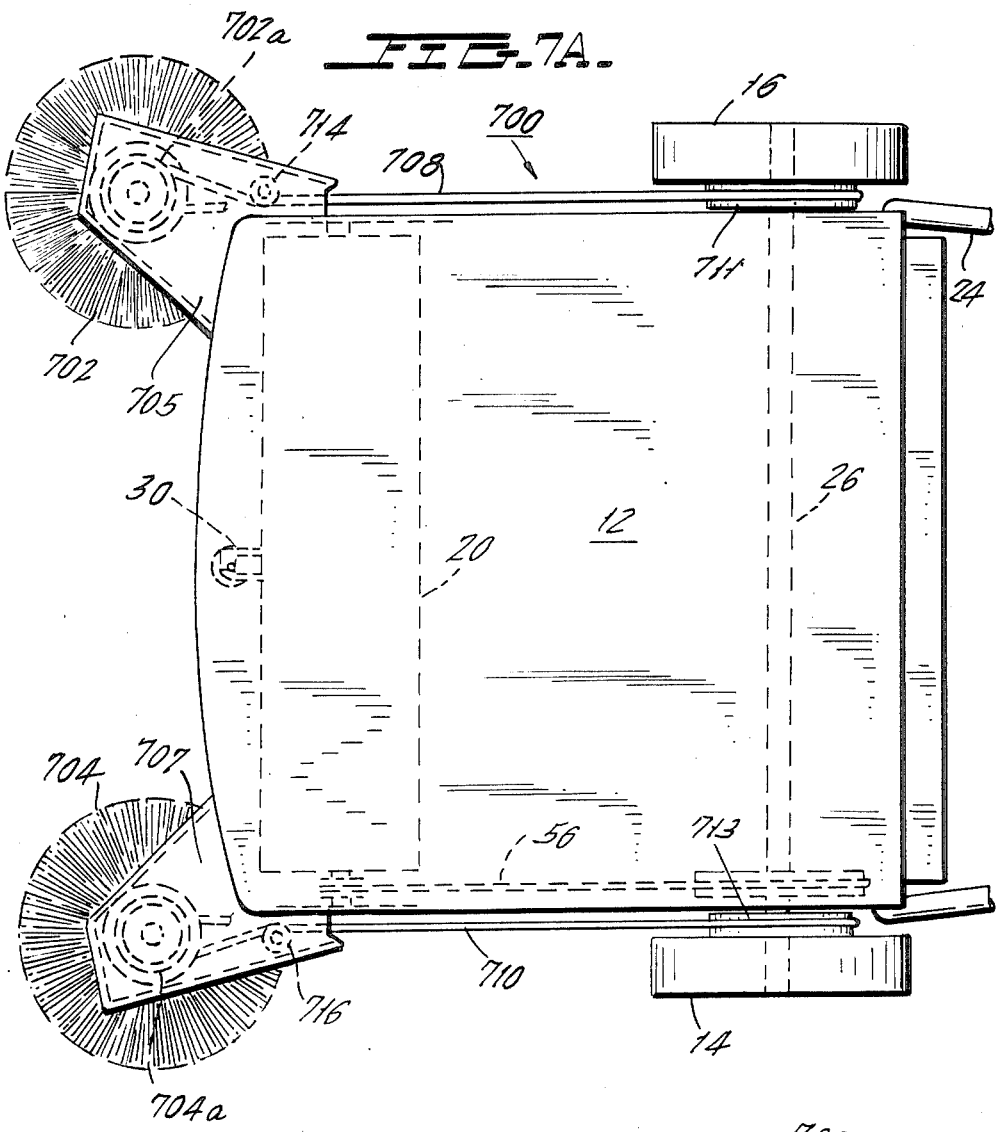
FIG. 7A is a schematic top plan view of an embodiment of the rotary brush sweeper of the invention that includes rotary side brooms at the front of the sweeper.

FIG. 7A illustrates a rotary brush sweeper 700 including rotary side brooms 702 and 704 at the right and left sides of housing 12, respectively. Brooms 702 and 704 are rotably mounted to housing 12 via respective supports 705 and 707 that are attached to the housing. Brooms 702 and 704 are belt driven from respective belts 708 and 710 that may be the same in construction as belt 56 (shown in broken lines) used to drive rotary brush 20.

Belt 708 rides on three pulleys: a pulley 711 mounted on axle 26 adjacent drive wheel 16; a pulley 702*a* integral with an upper portion of broom 702; and a guide pulley 714 mounted on support 705 and allowing belt 708 to translate between vertical pulley 711 and lateral pulley 702*a*. The other belt 710 similarly rides on three corresponding pulleys 713, 716 and 704*a*.

Figure 7B:
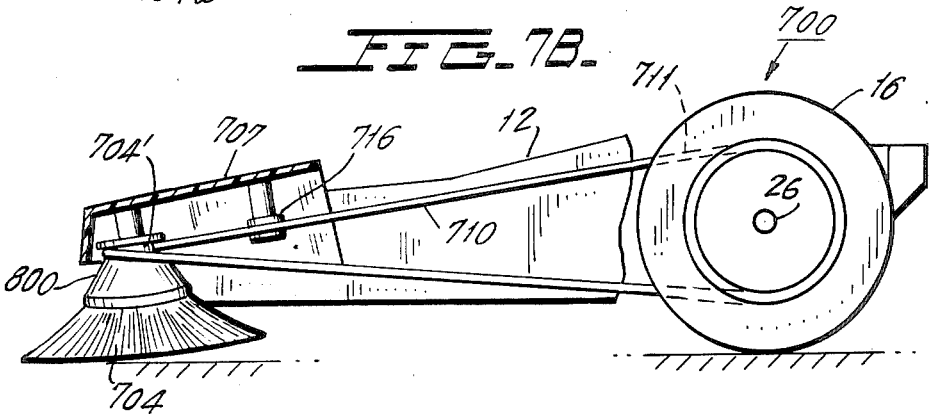
FIG. 7B is a schematic side plan view in partial cross-section illustrating a drive mechanism for the rotary side brooms shown in FIG. 7B.

FIG. 7B shows left-hand belt 710 in a left side view of rotary brush sweeper 700. It can be more easily seen in FIG. 7B that rotary broom 704 and pulley 716 are mounted to support 707 and that both pulleys 704*a* and 716 are lateral pulleys.

Figure 8:
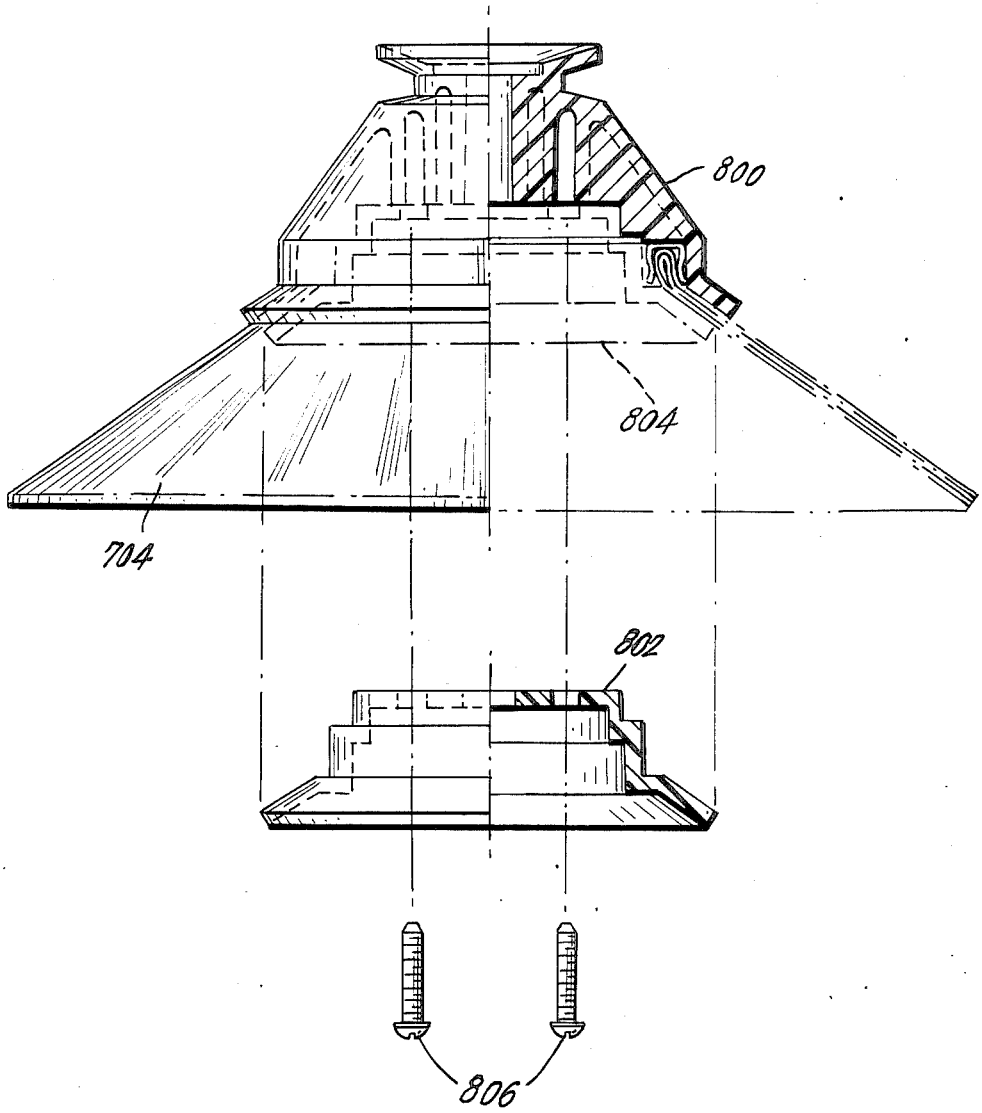
FIG. 8 is an exploded view of a novel side broom construction according to the invention.

FIG. 8 shows in exploded v1ew a rotary broom 702 or 704 of simplified construction in which upper and lower bristle supports 800 and 802 are adapted to interfit together and hold bristles 804 at a desired angle. Bristle supports 800 and 802 are sultably held together by screws 806.

The foregoing describes a rotary brush sweeper having a debris pan that glides over a surface to be cleaned. The pan automatically disengages from the sweeper should the pan become snagged by an obstacle on the surface. The pressure of the rotary brush against a surface to be cleaned may be easily adjusted through a simple threading adjustment of the support mechanism for a front wheel of the sweeper. The rotary brush is secured to the main housing of the sweeper by a simple and economical arrangement that relies on the tension of a drive belt included in the sweeper. Rotary side brooms may be mounted at the sides of the sweeper and benefit from having the broom-to-ground height also adjusted by the foregoing threadable support mechanism for the front wheel of the sweeper. The rotary sweeper is simple in construction and can be easily assembled.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A rotary brush sweeper for removing debris from a surface, comprising:

a housing having front and rear portions with respect to movement of the sweeper;

a brush rotatably supported by the housing;

drive means for rotating the brush;

a debris pan situated rearwardly of the brush for collection of debris swept thereinto by the brush;

pan support means for supporting the debris pan relative to the housing but for releasing the debris pan upon rearward pressure on the debris pan;

the pan support means comprising an aperture in a lateral suppport portion of the debris pan and a tab projecting from the housing in a generally rearward direction and adapted to protrude through the aperture to support the pan in a releasable manner upon rearward pressure on the pan.

2. The rotary brush sweeper of claim 1, wherein the aperture in the debris pan is situated in a rear portion of the pan, and the tab projecting from the housing is oriented in a rearward and upward direction.

3. The rotary brush sweeper of claim 2, wherein:

a front portion of the debris pan is configured in such a way as to render the front of the pan capable of gliding over the surface being cleaned by the sweeper; and the pan support notch of the front support means has a sufficient vertical dimension to permit vertical movement of the pan relative to the pan support member extending through the notch, thereby permitting the front of the pan to contact and glide on the surface being cleaned, even when the surface contour changes.

4. The rotary brush sweeper of claim 3, wherein the debris pan includes a front-to-rear extending rail situated at the front of the pan and which is adapted to glide on the surface being cleaned.

5. The rotary brush sweeper of claim 2, wherein the rear support means further comprses a further aperture in a rear portion of the pan, and a rearwardly-projecting detent mounted on the housing and being adapted to protrude through the further aperture to sturdily support the rear portion of the pan.

6. The rotary brush sweeper of claim 5, wherein:

the tab mounted on the housing comprises an upwardly projecting portion; and the rear of the pan includes a handle portion with a downwardly extending portion;

the upwardly and downwardly extending portions adapted to be pressed against each other so as to bias the detent into the aperture, whereby the debris pan is supported in the housing in a sturdy manner.

7. The rotary brush sweeper of claim 1, further comprising a front portion of the debris pan for riding on the surface to be cleaned, and constituting an inlet portion for receiving debris situated adjacent the brush, and the front portion being covered with a low friction material.

8. The rotary brush sweeper of claim 1, wherein the debris pan includes a plurality of transverse ribs situated interiorly of the pan and extending upwardly from a pan bottom so as to provide multiple bins in the debris pan in which collected debris is prevented from shifting.

9. The rotary brush sweeper of claim 1, further comprising height adjustment means for adjusting the height of the housing relative to the surface being cleaned so as to permit adjustment of the brush-to-surface contact pressure.

10. The rotary brush sweeper of claim 9, wherein the height adjustment means comprises a low friction support means for movably supporting the housing, and securing means for securing the low friction support means to the housing, the securing means comprising a vertically-extending and threadable coupling, whereby threading of the coupling varies the height of the housing.

11. The rotary brush sweeper of claim 10, wherein the securing means comprises a support sleeve depending downwardly from the housing and being internally threaded, and further including swivel means for mounting the low friction support means while permitting it to swivel; said swivel means including an upwardly extending member with external threads adapted to be threadedly received into the downwardly-depending support sleeve, whereby different degrees of brush-to-surface contact pressure may be provided by a threading adjustment.

12. The rotary brush sweeper of claim 11, wherein the low friction support means comprises a wheel.

13. The rotary brush sweeper of claim 9, further including a rotary side broom rotatably mounted at a side of the housing, and drive means for rotating the rotary side broom.

14. The rotary brush sweeper of claim 13, wherein the drive means for the rotary broom comprises an endless belt running through a pulley system comprising a vertical drive pulley, a lateral pulley integral with the rotary side broom and a lateral guide pulley for guiding the endless belt between the vertical drive pulley and the lateral pulley integral to the rotary side broom.

15. The rotary brush sweeper of claim 13, wherein the rotary side broom comprises a pair of interfitting bristle supports and a bristle arrangement adaped to be secured at a desired angle by being held beteen the interfiting bristle supports.

16. The rotary brush sweeper of claim 1, wherein the brush includes an axle with a drive end; and the drive means includes a drive wheel supported by the housing and an endless belt coupling under tension the drive end of the brush axle and the drive wheel.

17. The rotary brush sweeper of claim 16, further including a brush support member depending from the housing, the brush support member including a brush support notch extending rearwardly and upwardly from a notch opening, the drive end of the brush axle being received into the notch, and the endless belt of the drive means holding under tension the drive axle in the notch.

18. The rotary brush sweeper of claim 1, wherein the lateral support portion of the debris pan is situated near the rear of the pan such that the aperture in the lateral support portion and the tab projecting from the housing support a rear portion of the debris pan; and further comprising front support means for supporting a front portion of the debris pan.

19. The rotary brush sweeper of claim 18, wherein the front and rear support means are additionally effective for permitting vertical displacement of the front of the pan by an amount sufficient to permit the front of the pan to contact and glide on the surface being cleaned, even when the contour thereof changes.

20. The rotary brush sweeper of claim 18, wherein the front support means comprises a front support member fixed to the pan and including a pan support notch extending rearwardly from a notch opening, and a cooperating, laterally extending support member depending from the housing and extending through the notch when the pan is in a supported position.

21. The rotary brush sweeper of claim 18, wherein the front support means comprises a front support member fixed to the pan and extending laterally and forwardly of the pan, and a cooperating, laterally extending support member depending from the housing and being situated beneath the pan front support member when the pan is in a supported position.

22. The rotary brush sweepr of claim 21, wherein:

a front portion of the debris pan is configured in such a way as to render the front of the pan capable of gliding on the surface being cleaned by the sweeper; and the pan front support member of the front support means is normally spaced above the laterally-extending support member which is beneath the pan front support member by a sufficient vertical dimension to permit vertical movement of the front of the pan relative to the housing, thereby permitting the front of the pan to contact and glide on the surface being cleaned, even when the surface contour changes.

23. The rotary brush sweeper of claim 22, wherein the debris pan includes a front-to-rear extending rail situated at the front of the pan and which is adapted to glide on the surface being cleaned.

24. A rotary brush sweeper for removing debris from a surface, comprising:

a housing having front and rear portions with respect to movement of the sweeper;

a brush rotatably supported by the housing;

drive means for rotating the brush;

a debris pan situated rearwardly of the brush for collection of debris swept thereinto by the brush, a front portion of the debris pan being configured in such a way as to render the front of the pan capable of gliding over the surface being cleaned by the sweeper; and pan support means for supporting the debris pan relative to the housing but for releasing the debris pan upon rearward pressure on the pan and, further, for permitting free vertical displacement of the front of the pan by an amount sufficient to allow the front of the pan to contact and glide on the surface being cleaned, even when the contour thereof changes.

25. The rotary brush sweeper of claim 24, wherein the pan support means comprises an aperture in a lateral support portion of the debris pan, and a tab projecting from the housing in a generally rearward direction and adapted to protrude through the aperture to support the pan in a releasable manner upon rearward pressure on the pan.

26. The rotary brush sweeper of claim 25, wherein the aperture in the debris pan is situated in a rear portion of the pan, and the tab projecting from the housing is oriented in a rearward and upward direction.

27. The rotary brush sweeper of claim 26, wherein the lateral support portion of the debris pan is situated near the rear of the pan such that the aperture in the lateral support portion and the tab projecting from the housing support a rear portion of the debris pan; and further comprising front support means for supporting a front portion of the debris pan.

28. Thye rotary brush sweeper of claim 27, wherein the front support means comprises a front support member fixed to the pan and including a pan support notch extending rearwardly from a notch opening, and a cooperating, laterally extending support member depending from the housing and extending through the notch when the pan is in a supported position.

29. The rotary brush sweeper of claim 27, wherein the front support means comprises a front support member fixed to the pan and extending laterally and forwardly of the pan, and a cooperating, laterally extending support member depending from the housing and being situated beneath the pan front support member when the pan is in a supported position.

30. The rotary brush sweeper of claim 25, further comprising a further aperture in a rear portion of the pan, and a rearwardly projecting detent mounted on the housing and being adapted to protrude through the further aperture to sturdily support the rear portion of the pan.

31. The rotary brush sweeper of claim 30, wherein:

the tab mounted on the housing comprises an upwardly projecting portion; and the rear of the pan includes a handle portion with a downwardly extending portion;

the upwardly and downwardly extending portions adapted to be pressed against each other so as to bias the detented into the aperture, whereby the debris pan is supported in the housing in a sturdy manner.

32. A rotary brush sweeper for removing debris from a surface; comprising:

a housing having front and rear portions with respect to movement of the sweeper;

a brush rotatably supported by the housing;

drive means for rotating the brush;

a debris pan situated rearwardly of the brush for collection of debris swept thereinto by the brush; and pan support means for supporting the debris pan relative to the housing but for releasing the debris pan upon rearward pressure on the pan;

the pan support means comprising front and rear support means for respectively supporting front and rear portions of the debris pan; the front support means comprising a front support member fixed to the pan and extending forwardly of the pan, and a cooperating, laterally extending support member depending from the housing and being situated beneath the pan front support member when the pan is in a supported position;

the front and rear support means being additionally effective for permitting vertical displacement of the front of the pan by an amount sufficient to allow the front of the pan to contact and glide on the surface being cleaned, even when the contour thereof changes.

33. The rotary brush sweeper of claim 32, wherein the rear support means comprises a laterally extending aperture in a rear portion of the pan, and a tab projecting from the housing in a rearward and upward direction and being adapted to protrude through the aperture to support the rear portion of the pan.

34. The rotary brush sweeper of claim 33, wherein the rear support means further comprises a further aperture in a rear portion of the pan, and a rearwardly projecting detent mounted on the housing and being adapted to protrude through the further aperture to sturdily support the rear portion of the pan.

35. The rotary brush sweeper of claim 34, wherein:

the tab mounted on the housing comprises an upwardly projecting portoin; and the rear of the pan includes a handle portion with a downwardly extending portion;

the upwardly and downwardly extending portions adapted to be pressed against each other so as to bias the detent into the aperture, whereby the debris pan is supported in the housing in a sturdy manner.

36. A rotary brush sweeper for removing debris from a surface, comprising:

a housing having front and rear portions with respect to movement of the sweeper;

a brush rotatably supported by the housing;

drive means for rotating the brush;

a debris pan situated rearwardly of the brush for collection of debris swept thereinto by the brush; and pan support means for supporting the debris pan relative to the housing but for releasing the debris pan upon rearward pressure on the pan;

the pan support means comprising front and rear support means for respectively supporting front and rear portions of the debris pan; the front supporting means comprising a front support member fixed to the pan and including a pan support notch extending rearwardly from a notch opening, and a cooperating, laterally extending support member depending from the housing and extending through the notch when the pan is in a supported position.

37. The rotary brush sweeper of claim 36, wherein the front and rear support means are additionally effective for permitting vertical displacement of the front of the pan by an amount sufficient to allow the front of the pan to contact and glide on the surface being cleaned, even when the contour thereof changes.

38. The rotary brush sweeper of claim 37, wherein the rear support means comprises a laterally extending aperture in a rear portion of the pan, and a tab projecting from the housing in a rearward and upward direction and being adapted to protrude through the aperture to support the rear portion of the pan.

39. The rotary brush sweeper of claim 38, wherein the rear support means further comprises a further aperture in a rear portion of the pan, and a rearwrdly projecting detent mounted on the housing and being adapted to protrude through the further aperture to sturdily support the rear portion of the pan.

40. The rotary brush sweeper of claim 39, wherein:

the tab mounted on the housing comprises an upwardly projecting portion; and the rear of the pan includes a handle portion with a downwardly extending portion;

the upwardly and downwardly extending portions are adapted to be pressed against each other so as to bias the detent into the aperture, whereby the debris pan is supported in the housing in a sturdy manner.

* * * * *